US006988644B1

(12) United States Patent
Asherbranner

(10) Patent No.: US 6,988,644 B1
(45) Date of Patent: Jan. 24, 2006

(54) BABY CARRIER SUITABLE FOR WATER IMMERSION

(76) Inventor: Camisha G. Asherbranner, 1215 Autumn La., Hartselle, AL (US) 35640

( * ) Notice: Subject to any disclaimer, the term of this patent is extended or adjusted under 35 U.S.C. 154(b) by 112 days.

(21) Appl. No.: 10/636,957

(22) Filed: Aug. 8, 2003

(51) Int. Cl.
*A61G 1/00* (2006.01)

(52) U.S. Cl. ..... 224/160

(58) Field of Classification Search ..... 224/160, 224/163, 159, 158
See application file for complete search history.

(56) References Cited

U.S. PATENT DOCUMENTS

| | | | | | |
|---|---|---|---|---|---|
| 4,009,808 | A | | 3/1977 | Sharp | |
| 4,402,440 | A | * | 9/1983 | Purtzer et al. | 224/160 |
| 4,434,920 | A | * | 3/1984 | Moore | 224/160 |
| 4,436,233 | A | * | 3/1984 | Hill et al. | 224/159 |
| 4,903,873 | A | * | 2/1990 | Poole et al. | 224/160 |
| 5,205,450 | A | * | 4/1993 | Derosier | 224/161 |
| 5,246,152 | A | | 9/1993 | Dotseth | |
| 5,289,959 | A | * | 3/1994 | Beeley et al. | 224/160 |
| D370,996 | S | * | 6/1996 | Shimura et al. | D3/214 |
| 5,570,823 | A | * | 11/1996 | Lindy | 224/160 |
| 5,791,535 | A | * | 8/1998 | Roan et al. | 224/160 |
| 5,848,741 | A | * | 12/1998 | Fair | 224/160 |
| 5,927,576 | A | | 7/1999 | Nielsen | |
| 6,098,857 | A | * | 8/2000 | Le Gal | 224/161 |
| 6,283,347 | B1 | * | 9/2001 | Roh | 224/160 |
| 6,325,259 | B1 | * | 12/2001 | Tharalson et al. | 224/161 |
| D455,546 | S | * | 4/2002 | Norman | D3/214 |
| 6,409,060 | B2 | | 6/2002 | Donine | |
| 6,598,771 | B2 | * | 7/2003 | Norman | 224/160 |
| 6,763,983 | B2 | * | 7/2004 | Norman | 224/160 |

* cited by examiner

*Primary Examiner*—Stephen K. Cronin
(74) *Attorney, Agent, or Firm*—Fredric T. Morelle

(57) ABSTRACT

A baby carrier, useful generally in water environments and featuring an integrated harness-seat-headrest. The carrier is constructed unitarily of a water-proof, flexible fabric, which is, at least in the seat portion, water-permeable, in order to rapidly drain water away from the baby. The harness portion features a main pair of straps adapted to fit over the shoulders, of the carrier bearer, and descend over the bearer's back and chest to join and communicate with the seat. The strap pair is connected by a yoke or at least one transverse strap that restrains either main strap from slipping from the bearer's shoulders; and, absent such, is otherwise restrained in crisscross relationship over the bearer's back. The headrest may be positioned and fixed in a functional posture, or folded down.

14 Claims, 3 Drawing Sheets

BABY CARRIER SUITABLE FOR WATER IMMERSION

CROSS-REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This invention relates generally to baby carriers, that is, back- or chest-pack carriers for toddlers and infants (hereinafter "baby" or "babies"); and, more specifically, it conceives a unitary device that features an integrated harness-seat-headrest ensemble fabricated in a water-proof, flexible fabric. Moreover, the fabric used in this invention is permeable to liquids, at least the seat portion, deriving such character from its knit/weave, perforate, or mesh construction, so as to facilitate a rapid drainage of water from the baby's seating compartment.

2. Discussion of Relevant Art

Several types of holding or carrying devices for transporting babies are extant. These include harness carriers such as back-packs or chest-packs, wherein the baby is afforded a seat element and is positioned in a face-toward or -away posture, with respect to the bearer. In a similar vein, many are the devices that hold and posture a baby for the purposes of bathing; but none of which, in my experience, contemplate a concurrent immersion of baby and the adult bather. Neither does there appear to exist a device or apparatus of the first-mentioned carrier genre that is simple in construction, readily adapted to chest- or back-pack carriage, toward (facing) or away posturing of the carried baby and, most notably, suited for water immersion of both bearer and baby, with proper and rapid draining of the baby seat element. I am aware of these deficiencies in the art, having had conducted a search in the records of the U.S. Patent Office. Following are the various disclosures which were obtained and that appear relevant to my invention.

Patent(s) issued to Donine, U.S. Pat. No. 6,409,060 ('060), and Dotseth, U.S. Pat. No. 5,246,152 ('152), are deemed most relevant. In '060, there is shown an infant carrier having a shoulder harness subtending a lower panel that, in retro-flexion, ascends to lateral connections (multiple points) on the harness, thus forming a seat cradle. An infant seat (insert) is attached to the harness and deposited into the cradle. There is no suggestion that the cradle, alone, be employed as the infant's seat, nor could it reasonably function as such. The use of this insert compels the infant to face outward of the bearer, whether the ensemble is used in back-pack or chest carriage; however, great familiarity with the device appears necessary, were a single bearer to insert an infant and don the ensemble for back-pack carriage. Notably different from '060, the patent issued to Dotseth, '152, shows a unitary construct having a simple harness, lacking a cross-strap retention means, that subtends a foldable, elongate flap. This flap is upwardly foldable to connect with the harness shoulder straps, thereby forming a pouch-seat, for holding an infant. Although '152 suggests both front and back portability, it is readily apparent that use by a single bearer, when securing an infant in the back-pack mode, would be very difficult. More importantly, neither '060 nor '152 suggest use of their apparatus in the water environments previously mentioned.

A patent to Sharp, U.S. Pat. No. 4,009,808 ('808), combines the inner seat and cradle concept of '060 with the cradle formed according to the principle seen in '152. The cradle combines a pouch with a harness, the straps of which cross, while attached to the pouch portion; therefore no other independent cross-strap retainer is required in order to restrain shoulder strap slippage, from off the shoulder. However, because it uses a separate seat unit, more or less "cocooned" by the harness and cradle, this assembly is clearly not suitable for water immersion. The Nielsen disclosure, U.S. Pat. No. 5,927,576 ('576) bears a resemblance to '152, save that the harness straps cross and are retained by a buckle, and the portion facing the bearer is open (no intervening fabric panel between bearer and baby).

Of less overall relevance, a patent to Lindy, U.S. Pat. No. 5,570,823 ('823), shows use of a mesh fabric (FIGS. 2, 4 and 5) that serves to ventilate the ensemble. The material, additional to the side (mesh) panels is not suited for immersion in water; and, as shown in the disclosure, were the apparatus to be so subjected, the seat-pouch would retain the water, much to the infant's discomfort, the protraction of which could prove irritating and, quite possibly, give rise to infection. The headrest, though fashioned of mesh (used for cooling), is not integrated with the back support, nor does it form the seat per se.

Incorporation by Reference

The following patents are hereby incorporated by reference, for the reasons given: U.S. Pat. No. 6,409,060, for its disclosure of a multiply-strapped harness with an integrated seat support; and, U.S. Pat. No. 5,927,576, for its showing of a simple harness with a back rest for the baby.

Definitions

Most terms used herein are to be taken as having their customary English meaning. When different or secondary meanings may be applied, I have, with their first use, employed quotation marks and, absent common usage, given their intended definition in parentheses. A few terms, however, are to be read with the following meanings (especially, in the claims):

- breathable—having capability of ventilation or liquid drainage;
- constrain—to restrain in the sense of holding back or holding together;
- ensemble—an assembly of parts (as in a set of clothing);
- hydro-permeable—specifically, allowing water or liquid of similar viscosity to pass through;
- integral—that (part) which is necessary to complete the whole;
- permeable—allowing the passing (through) of a fluid (i.e., gas or liquid);
- perforate—having a great multiplicity of foramens, not exclusive of a mesh or other breathable fabric;
- unitary—of unit (one) character—[the unit is not divisible by ordinary mechanical means, as such division would destroy, or seriously degrade, the unit's function]; and,
- waterproof—in referring to a substance (such as a fiber) that repels, sheds or is otherwise impervious to water.

BRIEF SUMMARY OF THE INVENTION

I have overcome the limitations and deficiencies of the relevant art, relative to the concurrent carriage of a baby, into an adult shower, bath, pool or the like, by designing, fabricating and testing a unitary baby-carrying ensemble that features an integrated harness-seat-headrest carrier constructed of a water-proof, flexible fabric. The fabric used in this invention is perforate, mesh, or of knit/weave construction that is characteristic of the well-known scuba diver's "wetsuit", in at least the seat portion, so as to facilitate a rapid drainage of water from the baby's compartment, more specifically, from his/her lower abdomen and posterior regions. The ensemble is adapted for carriage on the bearer's back or chest.

The harness is fashioned from a strong, water-proof material such as the polymer known as Neoprene® (Dupont's Neoprene polychloroprene), that is used extensively in wetsuits, and presents essentially a pair of straps that span the shoulders of the bearer, passing over the shoulders and descending generally downward over the bearer's back and chest areas, hereafter defined, respectively, as the reverse and obverse portions of my invention, as shown in the accompanying Drawings. In one embodiment, the reverse (portion) straps are crossed and adjustably maintained in a desired position by a slip-retention device; in an alternate embodiment, the two straps remain in a substantially parallel relationship by connection with one or more transverse spacing strap(s), or a yoke that resembles a collar, and is integrated with the straps. Adjustment and fitting of the harness is made by use of commonly known means, such as cinch rings, buckles or opposing hook and loop elements (known as VELCRO®). The shoulder straps of the obverse portion are maintained essentially parallel and constrained from an outward (off-the-shoulder) moment by a connective, orthogonally disposed pouch-strap. Preferably, the pouch of this constraining means contains a visor/shield that is fixed at one end inside the pouch and can be deployed therefrom, over the head of the baby. The ends of the obverse parallel straps then connect to the upper marginal portions of the baby seat-pouch.

The seat pouch is fashioned to conform loosely to the posterior of a baby and is a single piece of water-proof, hydro-permeable, (preferably) wetsuit material (ibid.), the only absolute requirement being that the preponderance of the material contacting the baby's buttock and groin areas must be permeable. Openings for the baby's legs are provided so as to fashion the commonly-known "saddle" area in the seat. The outward-facing (obverse) side of the seat extends upward to form a back support and headrest in the shape of a stylized T. The ends of the cross member (of the T) are secured, preferably by buttons or snap connectors, each end to one of the shoulder straps. Two straps extend from proximate the leg holes of the seat and lower abdomen-groin area thereof, to gird left and right sides of the bearer and tie, buckle or otherwise join the descending reverse-side harness straps. These are the principle adjustment points for the harness.

DETAILED DESCRIPTION OF THE INVENTION

Figure 1:
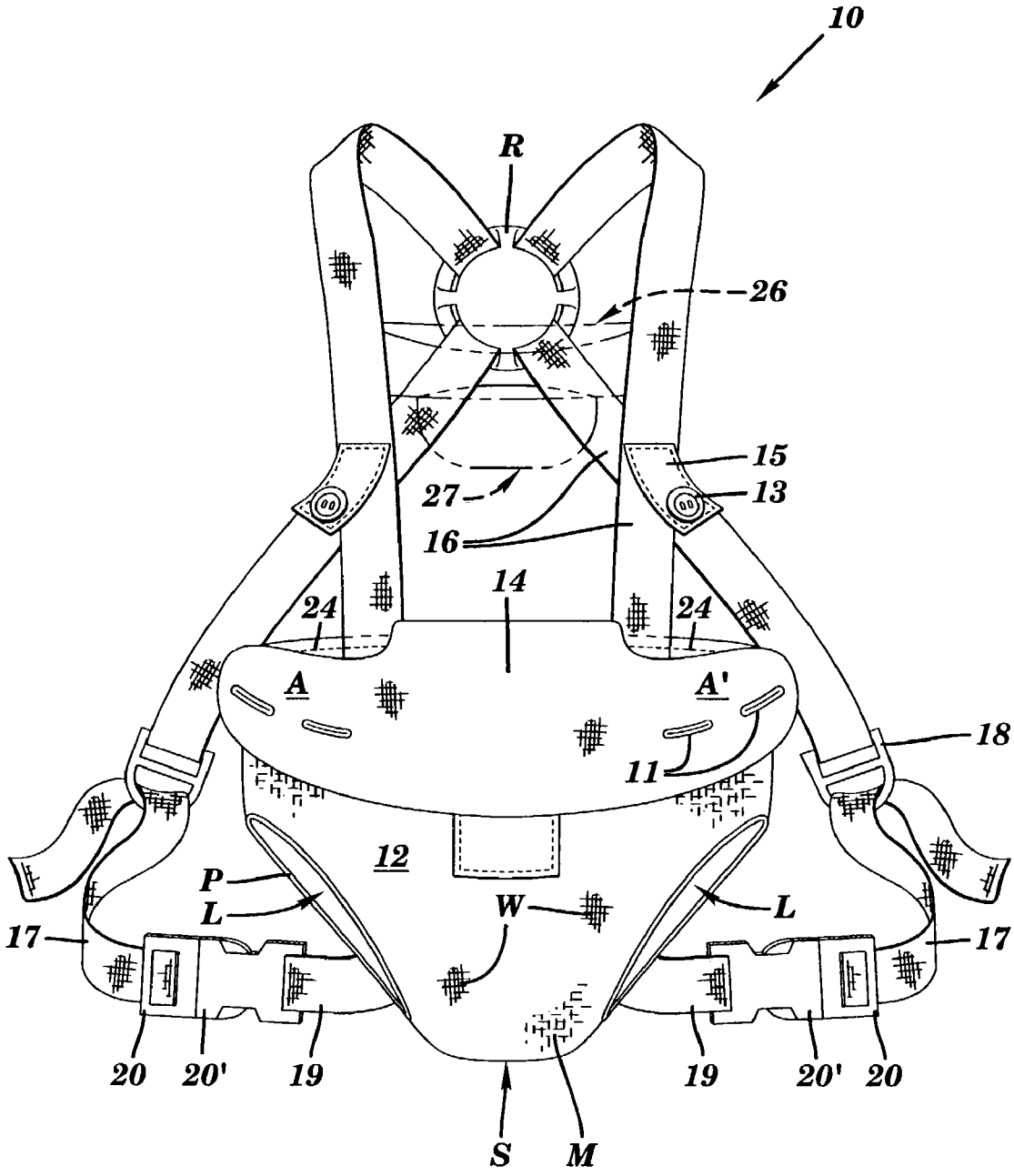
FIG. 1 is an illustration of the obverse face of the invention.

A facet of my invention that will be readily apparent is the simplicity of construction that allows its use, in the first instance, by practically any bearer who is strong enough to carry the baby in a chest- or back-pack mode. Adaptations, within the manufacturer's prerogatives, include: use (and mixed use) of the several water-proof materials available in the aforementioned hydro-permeable conventions; stylization of the harness in different patterns, to accommodate bearer preferences (e.g., with/without yoke); cloth in lieu of non-corrosive metals (or hard plastic buckles), snaps and/or connectors; and, shaping of the yoke, seat and headrest. Reference is now made to the Drawings:

FIG. 1 presents the invention 10, in a view looking toward its obverse face. The principal components, or elements, being: the baby's seat 12; a seat extension, the back/headrest flap 14 (folded downward); and, the back and chest straps of the harness 16. Remaining portions of the harness consist in: a pair of cinch rings 18, connected to each of the end portions of the back straps; a pair of adjustment straps 17, that are strung through the cinch rings and connect each to a portion of a buckle 20; a pair of buckle complements 20', that are each connected to one of a pair of short straps 19, which, in turn, are fixed to, and depend from piping P portions of each leg port L, proximate the seat saddle region S. At this point, it may be seen that the salient elements of my invention have been presented; and, that it is a single entity that will function adequately as a baby carrier, unless one of the integrated parts (the harness, with its cinches and connectors 16–20', or the seat 12, with/without extension 14) is removed. It is important, however, to point out and stress that the suitability for water immersion requires that the invention 10, at least in its seat 12 construction, be fabricated in a strong, water-permeable material W. As mentioned earlier, I have chosen to use a wetsuit standard, Dupont Corporation's product known as Neoprene®, for the construction of my entire ensemble, as described above; however, any waterproof, but liquid-permeable material would be suitable.

Continuing in FIG. 1, other facets of the invention, although not necessarily salient, are used in the interests of comfort and safety. A small-mesh waterproof netting (fabric) M is used to construct the seat proper, or the entire ensemble; however, I prefer the wetsuit material W and employ an over-covering mesh fabric only to strengthen the seat. The seat extension, a back/headrest 14 is integrated with the obverse side of the seat and formed as a stylized T. For supporting the baby's back and head, the T flap is raised and wrapped about the baby's shoulders and head. The crossbar or arms A, A' of the T are provided fastening means, that employ button holes 11, with the tab 15—extended buttons 13, in order to secure the back/headrest to the obverse straps 16. Often the bearer must stoop or bend; and, the likelihood of strap 16 slipping, from off the shoulder, becomes a very real hazard to the baby, regardless of whether the rest 14 is in place. Three elements are used, depending on manufacturing objectives, any one of which will negative such a hazard: a strap 26 (or two) is placed transversely to and connecting the harness main straps 16; a retainer R is used to cross and restrain the reverse portion (as shown in FIG. 1) of the straps; and, in lieu of either the transverse strap(s) or retainer, a yoke Y (shown in phantom, at FIG. 3), is integrated, with the harness main straps 16, covering the bearer's shoulders, so as to effect a collar for the ensemble. An advantage to using the transverse strap, drawn in phantom and positioned as shown here, is that it is realized as a dual functioning strap-pouch, in which there is stored, and from which is withdrawn, a shield 27, to protect the baby's head from sun or wind-driven elements.

Figure 2:
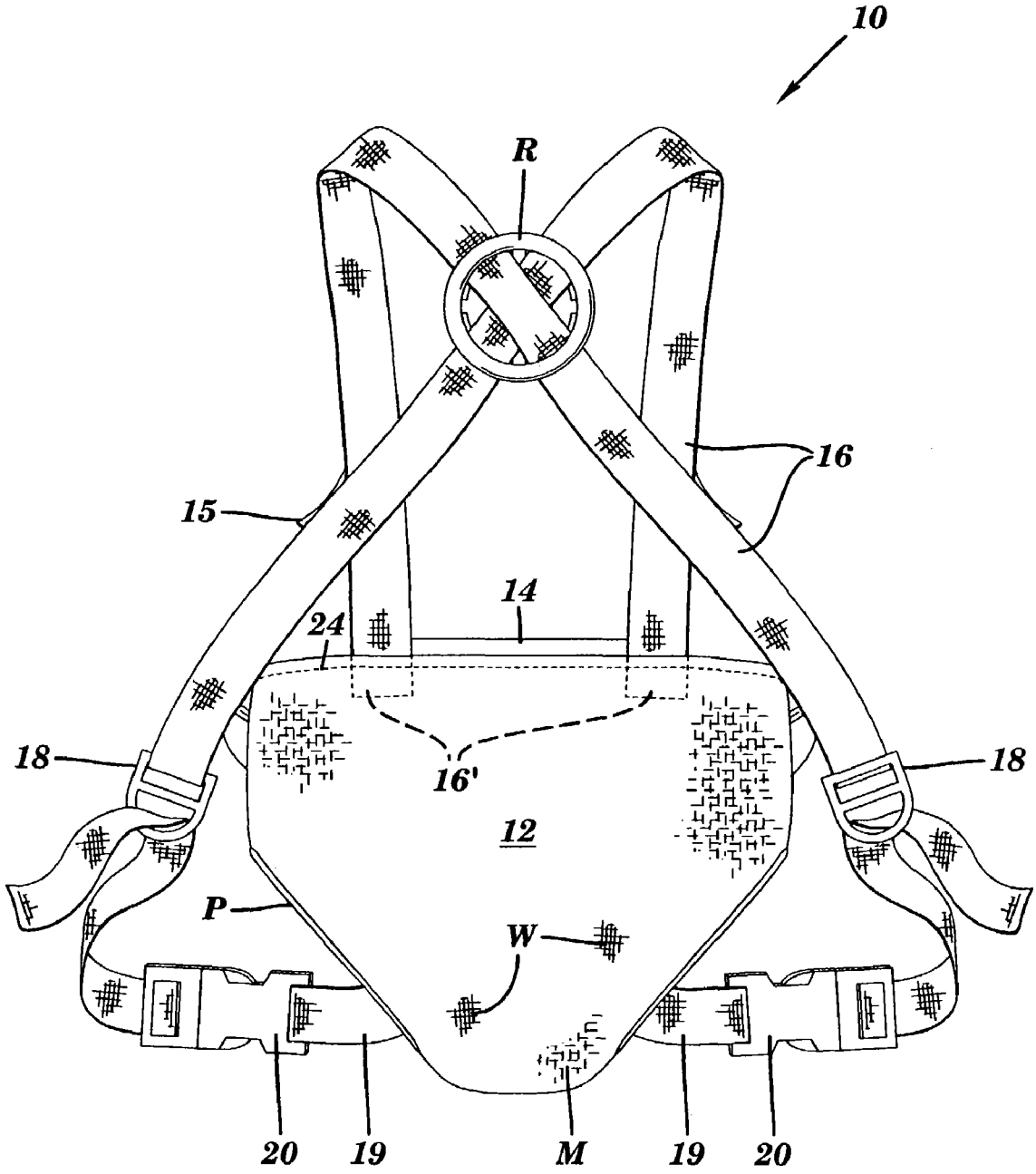
FIG. 2 is an illustration of the reverse face of the invention.

Referring now to FIG. 2, one sees the reverse side of the invention 10. In addition to the previously described seat 12 members and attachments (the piping P, wetsuit material W, mesh reinforcement M, and seat straps 19), there is shown the cross-strap retainer R and the obverse main strap 16 connections 16' to the reinforced upper hem 24 of the seat. The harness elements are as shown in the previous figure, absent the transverse strap 26 and shield 27.

Figure 3:
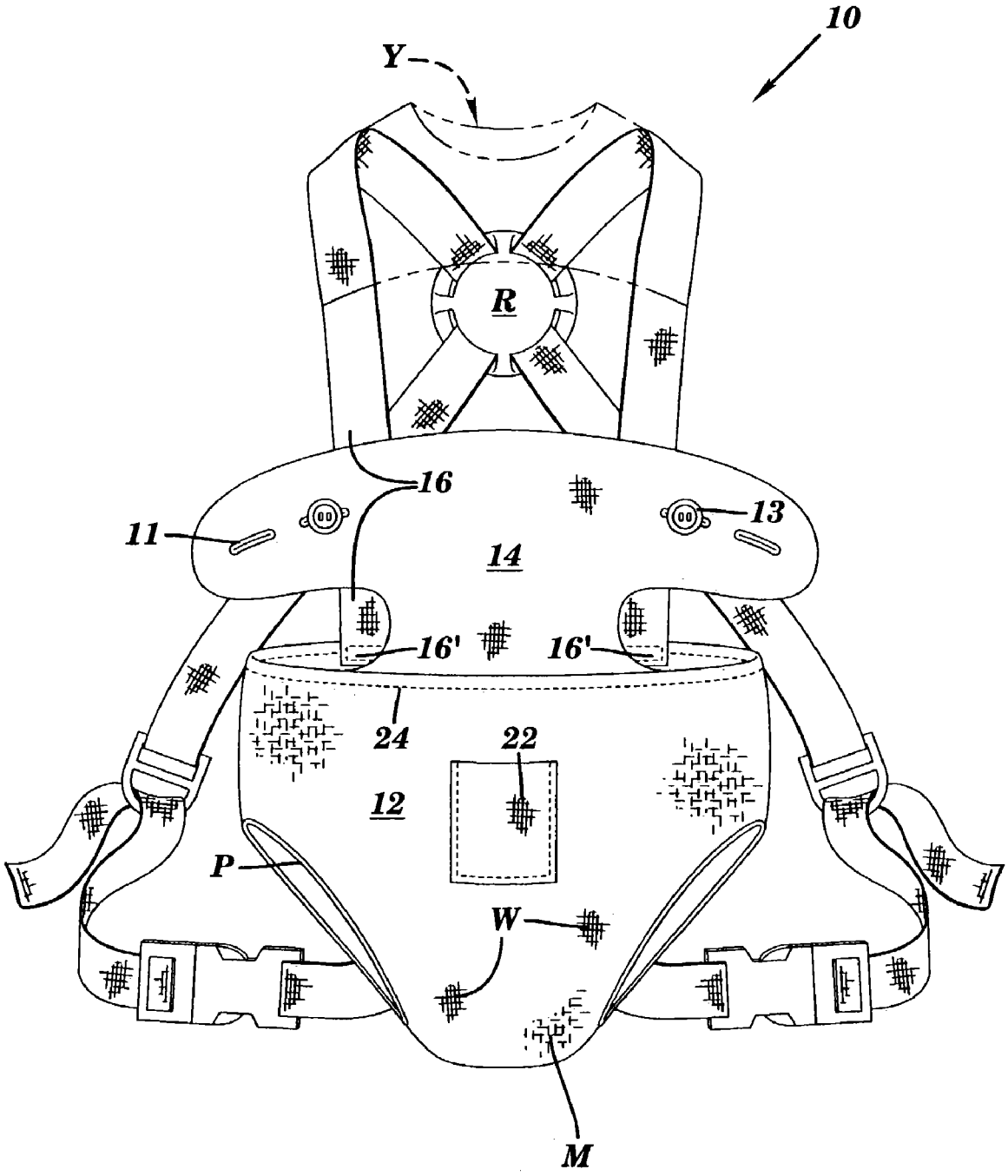
FIG. 3 is an illustration of the obverse face of the invention, with the back and head support in place.

Final to this description is FIG. 3, the FIG. 1 drawing having the back/headrest in functional position. Buttons 13 have been engaged with their holes 11 and the earlier-mentioned yoke Y is shown (in phantom) as wholly integrated with the harness (straps). If the yoke were to be used, it would be sufficient for retaining the straps, obverse or reverse, in any position desired; therefore, the maker would dispense with the retainer R. The obverse transverse strap-pouch 26 of FIG. 1, however could be retained, but as a logical extension of, or as an adjunct to, the yoke. To enhance heat dissipation, the yoke Y is made, preferably, from a strong, waterproof netting and is donned by slipping over the bearer's head, after the fashion of a poncho. Lastly, the reinforced hem 24 is shown with the straps 16 attached thereto at 16'; and, an optional accessories pocket 22 is provided on the obverse face of the seat.

This description has disclosed the necessary and sufficient elements that will provide the field with a simple and economic solution to those deficiencies discussed in the relevant art portion hereof. Those of ordinary skill are granted latitude in the provision of equivalent elements and structures to its construction, for example hook and fastener material for buckles, snaps for buttons, etc.; and, therefore, the invention is commended to the field consistent with the hereinafter appended claims.

What is claimed is:

1. A baby carrier, for carrying a baby into a shower in a back or chest carriage, in a combination comprising:

an integrated, unitary and waterproof ensemble featuring a harness and a monolithic, empty seat compartment pouch that is integral with the harness, said ensemble made of a homogeneous, waterproof fabric wherein at least the saddle region of the seat compartment pouch is characterized as substantially perforate and hydro-permeable so as to effect a rapid drainage of water therefrom;

the seat compartment pouch including an integral foldable headrest extending from an obverse face of the seat and wherein the headrest is shaped in the form of a stylized T;

the harness further comprising a pair of straps adapted to fit over the shoulders of a bearer of the carrier and descend over the bearer's back and chest in an essentially fixable relationship, said pair of straps communicating, in a first instance, only with a top margin of said seat compartment pouch and on a reverse face thereof, said pair of straps being interconnected one to the other by at least one constraining means for preventing either of the pair of straps from slipping off the shoulders of said bearer; said pair of straps communicating, in a second instance, and terminating at leg ports of said seat pouch; and wherein each end of the headrest T crossbeam is detachably fixable to one strap of a pair of straps featured in the harness.

2. The carrier of claim 1 wherein said harness constraining means comprises a yoke adapted for over-the-shoulder wear in poncho fashion and from which said pair of straps depend, each said strap being adjustable in length and communicable with the seat pouch.

3. The carrier of claim 1 wherein said headrest is foldable towards and against the seat pouch of the ensemble.

4. The carrier of claim 1 wherein said constraining means is at least one transverse strap fashioned as a strap-pouch with an elongate opening which faces the seat and from which is deployable a shield/screen.

5. The carrier of claim 1 wherein said constraining means is an element that retains the harness straps in a relatively fixed position.

6. The baby carrier of claim 1 made essentially of a homogeneous, hydro-permeable material.

7. A baby carrier suitable for showering and water immersion, in front back-pack configuration, comprising in combination:

an integrated and unitary ensemble including a harness, a monolithic seat shell and a readrest portion said ensemble being fabricated substantially in a water-proof, flexible fabric, wherein at least the fabric of the seat shell is further characterized as being hydro-permeable, at least in a saddle portion thereof, and comprises a structure selected from the class of constructions consisting of knit/weave, perforate, and mesh, so as to effect a rapid drainage and removal of effluent from said saddle portion of the seat shell;

the harness further comprising a pair of straps adapted to fit over the shoulders of a bearer of the carrier and descend over the bearer's back and chest in an essentially fixable relationship, said pair of straps in a first instance, communicating with a top margin of said seat shell at a reverse face thereof, said pair of straps being interconnected one to the other by an integral yoke, made from fabric of said class, that is whole and substantially conterminous with shoulder-contacting portions of each of the straps, the yoke providing said essentially fixable relationship between the pair of straps, said pair of straps communicating and terminating, in a second instance, at leg ports of said seat shell; and wherein said headrest is a flap extension of the seat and is shaped in the form of a stylized T, the ends of the crossbeam of said stylized T being detachably fixable to a pair of straps of said harness, said headrest being foldable towards and against the seat compartment.

8. The baby carrier of claim 7 where, in lieu of said yoke, the essentially fixable relationship between the straps is established by including therebetween a transversely fixed pouch-strap, containing a deployable shield.

9. The baby carrier of claim 7 wherein the retaining means is a strap-crossing retainer element.

10. A water-shedding and water-proof baby carrier characterized by:

an integrated harness-seat-headrest unit that is fabricated in a water-proof, flexible fabric, and which is suited for water immersion of both a bearer and a baby, wherein said seat is essentially a monolithic pouch having a single circular top margin and two lower leg ports, at least the fabric of the seat pouch of the integrated unit is further characterized as perforate, so as to facilitate a rapid drainage of water from within said seat pouch, said seat pouch extending integrally from said top margin at an obverse side thereof to effect the headrest of the unit, wherein the headrest emulates a stylized T and is adjustably and detachably fixable at each end of the crossbar of the T to extension tabs depending from the harness of the unit while being also foldable downwards, towards and against the seat pouch of the ensemble;

said harness of the unit being further characterized by a pair of straps adapted to fit over the shoulders of a bearer of the carrier and descend over the bearer's back and chest in an essentially fixable relationship, said pair of straps communicating with the sole top margin of the seat pouch and being connected one to the other by at least one constraining element for preventing either of the pair of straps from slipping off the bearer's shoulders, the pair of straps each communicating with and terminating at each of the leg ports.

11. The baby carrier of claim 10 wherein the unit is made essentially of a homogeneous, waterproof material that exhibits a water-permeability.

12. The baby carrier of claim 11 wherein the constraining element is an X shaped retainer used to cross and movably restrain a reverse portion of the straps.

13. The baby carrier of claim 11 wherein the constraining element is an over-the-shoulder poncho type yoke from which all said straps depend.

14. The baby carrier of claim 11 wherein the constraining element is a transverse strap-pouch connecting the pair of straps communicating with the sole top martin of the seat and wherein the strap-pouch contains a shield that is deployable therefrom.

* * * * *